US007762693B2

(12) United States Patent
Chu et al.

(10) Patent No.: US 7,762,693 B2
(45) Date of Patent: Jul. 27, 2010

(54) LAMP ASSEMBLY

(75) Inventors: Yuan-Fa Chu, Miao-Li Hsien (TW); Wen-Jang Jiang, Miao-Li Hsien (TW); Hung-Kuang Hsu, Miao-Li Hsien (TW)

(73) Assignee: Foxsemicon Integrated Technology, Inc., Chu-Nan, Miao-Li Hsien (TW)

( * ) Notice: Subject to any disclaimer, the term of this patent is extended or adjusted under 35 U.S.C. 154(b) by 192 days.

(21) Appl. No.: 12/051,694

(22) Filed: Mar. 19, 2008

(65) Prior Publication Data

US 2009/0046472 A1 Feb. 19, 2009

(30) Foreign Application Priority Data

Aug. 13, 2007 (CN) ..... 200710201346.8

(51) Int. Cl.
*F21V 5/00* (2006.01)
*F21V 7/04* (2006.01)

(52) U.S. Cl. ..... 362/329; 362/310; 362/296.05; 362/311.06

(58) Field of Classification Search ..... 362/329, 362/296.05–296.08, 296.03–296.04, 311.03–311.11, 362/310, 296.01, 327, 350, 349
See application file for complete search history.

(56) References Cited

U.S. PATENT DOCUMENTS

| | | | | |
|---|---|---|---|---|
| 4,506,316 | A * | 3/1985 | Thiry et al. | 362/309 |
| 4,907,044 | A | 3/1990 | Schellhorn et al. | |
| 5,723,868 | A | 3/1998 | Hammond, Jr. et al. | |
| 6,688,757 | B2 * | 2/2004 | Kovach et al. | 362/352 |

FOREIGN PATENT DOCUMENTS

| | | | |
|---|---|---|---|
| CN | 1404564 | A | 3/2003 |
| CN | 1203152 | C | 5/2005 |
| JP | 2005-85653 | A | 3/2005 |
| WO | WO0019547 | A1 | 4/2000 |

* cited by examiner

*Primary Examiner*—Bao Q Truong
(74) *Attorney, Agent, or Firm*—Andrew C. Cheng

(57) ABSTRACT

A lamp assembly (10) is provided. The lamp assembly includes a lamp cover (12) having a first end (120) and an opposite second end (122). The lamp cover tapers from the second end to the first end. A hydrophobic coating (128) is formed on and covers an outer surface of the lamp cover. A light source (16) is received in the lamp cover.

10 Claims, 2 Drawing Sheets

LAMP ASSEMBLY

BACKGROUND

1. Technical Field

The present invention relates to lamp assemblies, and particularly to an outdoor lamp assembly with a self-cleaning outer surface.

2. Description of Related Art

Surfaces of outdoor lamps have been protected against encrustation and corrosion by means of painting or coatings containing polymer films. One disadvantage of such painting or coatings is that they do not achieve multi-purpose protection since they are not generally versatile enough to protect against damage from a variety of causes.

What is needed, therefore, is a lamp assembly which not only can protect against encrustation and corrosion, but also has a dust and humidity protection.

SUMMARY

In a present embodiment, a lamp assembly is provided. The lamp assembly includes a lamp cover having a first end and an opposite second end. The lamp cover tapers from the second end to the first end. A hydrophobic coating is formed on and covers an outer surface of the lamp cover. A light source is received in the lamp cover.

Other advantages and novel features of the present invention will become more apparent from the following detailed description of preferred embodiment when taken in conjunction with the accompanying drawings.

BRIEF DESCRIPTION OF THE DRAWINGS

Many aspects of the lamp assembly can be better understood with reference to the following drawings. The components in the drawing are not necessarily drawn to scale, the emphasis instead being placed upon clearly illustrating the principles of the present lamp assembly. Moreover, in the drawings, like reference numerals designate corresponding parts throughout the several views.

DETAILED DESCRIPTION OF THE PREFERRED EMBODIMENTS

Embodiments of the present lamp assembly will now be described in detail below and with reference to the drawings.

Figure 1:
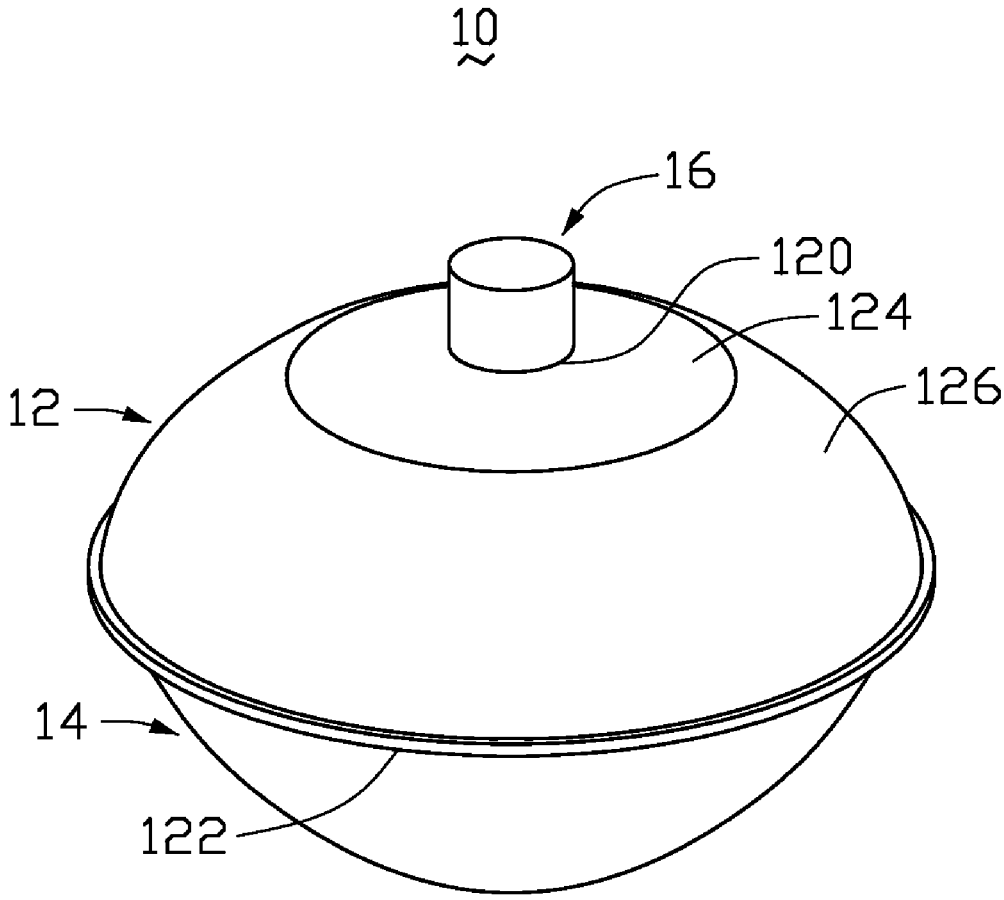
FIG. 1 is a perspective view of a lamp assembly according to an embodiment of the present invention.
Figure 2:
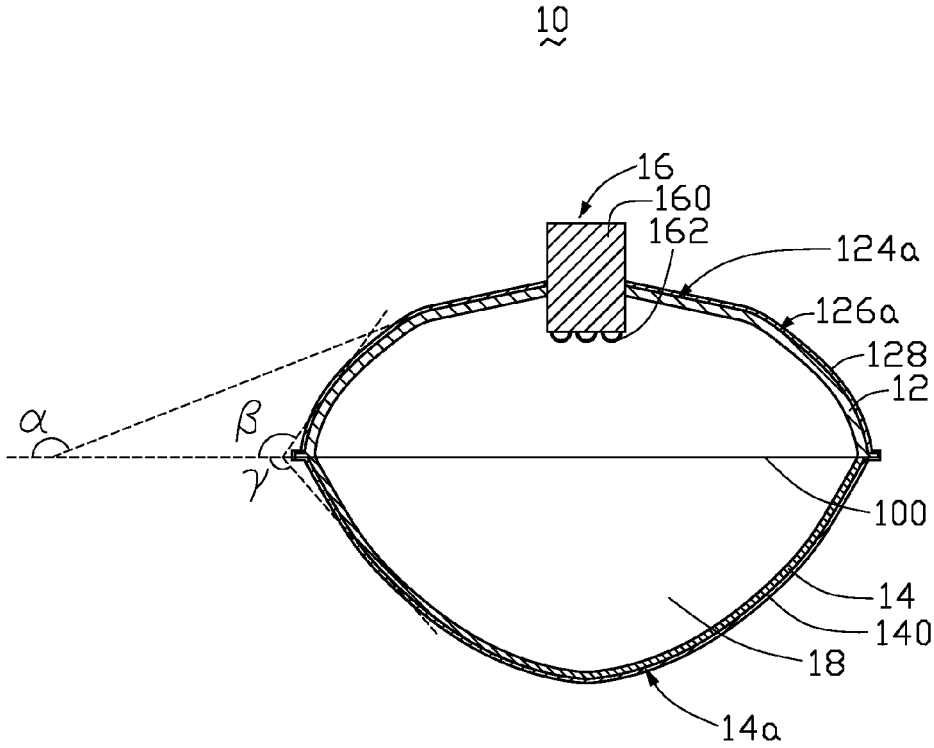
FIG. 2 is a cross-sectional view of the lamp assembly in FIG. 1.

Referring to FIGS. 1 and 2, an exemplary lamp assembly 10 includes a lamp cover 12, a light permeable cover 14, and a light source 16. The light source 16 is positioned within the lamp cover 12.

The lamp cover 12 includes a first opening 120 and a second opening 122. The lamp cover 12 tapers from the second opening 122 to the first opening 120. The first opening 120 is in the center of the lamp cover 12 and configure for receiving the light source 16 thereof. The second opening 122 has a diameter comparable in the size to the light permeable cover 14. The walls of the lamp cover 12 at the second opening 122 and the light permeable cover 14 abut against one another, and sealed together, i.e., the permeable cover 14 is attached to the second opening 122 of the lamp cover 12. The junction between the lamp cover 12 and the light permeable cover 14 defines a reference plane 100. The seal may be accomplished in one of a number of ways known in the art. The union of the lamp cover 12 and the light permeable cover 14 defines a cavity 18.

The wall of the lamp cover 12 includes a first portion 124 at the first opening 120 and a second portion 126 at the second opening 122. The first portion 124 has a cup-like shape and is formed from a section of a hyperbola of revolution or other similar surface. The second portion 126 is adjacent to the first portion 124. The second portion 126 is also formed as a section of hyperbola of revolution or other similar surface. In the present embodiment, the first portion 124 appears more like a section of a cone than the second portion 126. Each of the first portion 124 and the second portion 126 has a focal point at or near the light source 16. The angle $\alpha$ between the outer surface 124*a* of the first portion 124 and the reference plane 100 is in a range between 90° and 171.5°. The angle $\beta$ between the outer surface 126*a* of the second portion 126 and the reference plane 100 is in a range between 90° and 171.5°. In the present embodiment, the angle $\beta$ is smaller than the angle $\alpha$, the angle $\alpha$ equals to 160°, and the angle $\beta$ equals to 120°.

The light source 16 includes an electrical socket/connector 160 (e.g., a standard bulb assembly) and at least one LEDs 162. The electrical socket/connector 160 is attached to the lamp cover 12 at the first opening 120. When the electrical socket/connector 160 is attached to the lamp cover 12, the at least one LEDs 162 enters the cavity 18 through the first opening 120.

The light permeable cover 14 is made of transparent or translucent materials, such as glass or plastic materials. The material is colored to selectively pass light of a specific wavelength or wavelengths. Thus, the light permeable cover 14 imparts a color, which light transmitted therethrough. The light permeable cover 14 can be a plate, a lens array or a lens. The outer surface of the light permeable cover 14 is a hyperbola of revolution or other similar surface, such as a conic surface. The angle $\gamma$between the outer surface 14a of the light permeable cover 14 and the reference plane 100 is in a range between 90° and 135°. The lamp cover 12 and the light permeable cover 14 define a filbert-like shaped lamp assembly 10. Water and dust on the outer surface of the lamp cover 12 can easily drop away from such a lamp assembly.

A hydrophobic coating 128 is formed on the outer surface of the lamp cover 12. A transparent hydrophobic coating 140 is formed on the outer surface of the light permeable cover 14. The hydrophobic coating 128 and the transparent hydrophobic coating 140 are water-proof coatings which have immediate uses in reducing icing and fouling of outer surface of the lamp cover 12. Such coatings can also protect from surfaces formation of water soluble electrolytes such as acids and alkalies, and by microorganisms.

The hydrophobic coating 128 and the transparent hydrophobic coating 140 are at a contact angle of at least 140°. In the present embodiment, the material of the hydrophobic coating 128 can be Teflon or other hydrophobic material in the art. The material of the transparent hydrophobic coating 140 can be Polydimethylsiloxane or other similar materials. The transparent hydrophobic coating 140 in the present embodiment has a high contact angle above 165°.

The outer surface of the hydrophobic coating 128 and the transparent hydrophobic coating 140 can further include a rough structure. The rough structure has considerably lower profile heights and distances between profile peaks than the dust and water on the outer surface of the lamp cover 12, so as to increase the speed of water and dust drop away from the outer surface.

It is understood that the above-described embodiments are intended to illustrate rather than limit the invention. Variations may be made to the embodiments and methods without departing from the spirit of the invention. Accordingly, it is appropriate that the appended claims be construed broadly and in a manner consistent with the scope of the invention.

What is claimed is:

1. A lamp assembly, comprising:

a lamp cover having a first end and an opposite second end, the lamp cover tapering from the second end to the first end;

a hydrophobic coating formed on and covering an outer surface of the lamp cover;

a light source attached to the first end of the lamp cover;

a light permeable cover attached to the second end of the lamp cover, the light permeable cover and the lamp cover cooperatively defining a cavity with the light source received therein, wherein an angle between the outer surface of the light permeable cover and a surface defined by the second end is in a range between 90° and 135°; and a transparent hydrophobic coating is formed on an outer surface of the light permeable cover.

2. The lamp assembly as described in claim 1, wherein a material of the hydrophobic coating on the outer surface of the lamp cover is Teflon.

3. The lamp assembly as described in claim 1, wherein the lamp cover comprises a first portion at the first end and a second portion at the second end, and the light source comprises a lamp facing away from the first portion of the lamp cover.

4. The lamp assembly as described in claim 3, wherein the outer surface of the first portion of the lamp cover is shaped as a part of a hyperbola of revolution, and an angle between the outer surface of the first portion and the surface defined by the second end is in a range between 90° and 171.5°.

5. The lamp assembly as described in claim 1, wherein the outer surface of the first portion of the lamp cover is shaped as a part of a cone, and an angle between the outer surface of the first portion and a surface defined by the second end is in a range between 90° and 171.5°.

6. The lamp assembly as described in claim 4, wherein the outer surface of the second portion of the lamp cover is shaped as a part of a hyperbola of revolution, and an angle between the outer surface of the second portion of the lamp cover and the surface defined by the second end is smaller than that between the outer surface of the first portion of the lamp cover and the surface defined by the second end.

7. The lamp assembly as described in claim 1, wherein the outer surface of the light permeable cover is shaped as a part of a hyperbola of revolution.

8. The lamp assembly as described in claim 1, wherein the outer surface of the light permeable cover is a conic surface.

9. The lamp assembly as described in claim 1, wherein a material of the transparent hydrophobic coating is polydimethylsiloxane.

10. The lamp assembly as described in claim 6, wherein the angle between the outer surface of the first portion and the surface defined by the second end is 160°, and the angle between the outer surface of the second portion and the surface defined by the second end is 120°.

* * * * *